US009422750B2

(12) United States Patent
Gutierrez et al.

(10) Patent No.: US 9,422,750 B2
(45) Date of Patent: Aug. 23, 2016

(54) RANGE LIMITED LATCH

(71) Applicant: Waterloo Industries, Inc., Oak Creek, WI (US)

(72) Inventors: Sergio Herrera Gutierrez, Sonora (MX); Jiju Johnson, Milwaukee, WI (US)

(73) Assignee: WATERLOO INDUSTRIES, INC., Oak Creek, WI (US)

( * ) Notice: Subject to any disclaimer, the term of this patent is extended or adjusted under 35 U.S.C. 154(b) by 0 days.

(21) Appl. No.: 14/457,547

(22) Filed: Aug. 12, 2014

(65) Prior Publication Data

US 2015/0048732 A1 Feb. 19, 2015

Related U.S. Application Data

(60) Provisional application No. 61/865,249, filed on Aug. 13, 2013.

(51) Int. Cl.

| | |
|---|---|
| ***E05B 65/44*** | (2006.01) |
| ***E05B 65/46*** | (2006.01) |
| ***E05C 3/14*** | (2006.01) |
| ***E05C 3/16*** | (2006.01) |

(52) U.S. Cl.

CPC ..... *E05B 65/46* (2013.01); *E05C 3/14* (2013.01); *E05C 3/16* (2013.01); *Y10T 292/57* (2015.04)

(58) Field of Classification Search

CPC ..... A47B 88/04; A47B 95/02; A47B 96/00; E05B 65/44; E05B 65/46; E05C 3/12; E05C 3/14; E05C 3/16

USPC ..... 312/330.1, 333, 332.1, 215, 222

See application file for complete search history.

(56) References Cited

U.S. PATENT DOCUMENTS

| | | | | |
|---|---|---|---|---|
| 1,059,952 | A | 4/1913 | Spooner | |
| 1,453,121 | A | 4/1923 | Benner | |
| 1,549,422 | A * | 8/1925 | Mohun et al. | 292/100 |
| 1,897,080 | A | 2/1933 | Soper | |
| 2,028,954 | A * | 1/1936 | Roedding | 292/126 |
| 2,197,195 | A | 4/1940 | Schmers | |
| 2,805,911 | A | 9/1957 | Anderson | |
| 2,944,864 | A | 7/1960 | Krivulka | |

(Continued)

FOREIGN PATENT DOCUMENTS

| | | |
|---|---|---|
| TW | 471519 | 1/2002 |
| TW | 530731 | 5/2003 |

(Continued)

OTHER PUBLICATIONS

International Search Report and Written Opinion from International Application No. PCT/US2014/050669, date of mailing Dec. 3, 2014.

(Continued)

*Primary Examiner* — James O Hansen

(74) *Attorney, Agent, or Firm* — Calfee, Halter & Griswold LLP

(57) ABSTRACT

A latch mechanism includes a latchable structure and a latch member assembled with the latchable structure and movable between a latching position and a releasing position. The latch member includes a first stop portion positioned to engage a second stop portion carried by the latchable structure when the latch member is in one of the latching position and the releasing position.

23 Claims, 11 Drawing Sheets

(56) References Cited

U.S. PATENT DOCUMENTS

| | | | | |
|---|---|---|---|---|
| 3,120,412 | A | 2/1964 | Caldwell | |
| 3,239,298 | A | 3/1966 | McCarthy | |
| 3,252,746 | A | 5/1966 | Kafferlin | |
| 3,294,463 | A | 12/1966 | Kafferlin | |
| 3,338,649 | A | 8/1967 | Stewart | |
| 3,450,453 | A | 6/1969 | Tazaki | |
| 3,549,228 | A | 12/1970 | Aleks | |
| 3,574,436 | A | 4/1971 | Anderson | |
| 3,709,538 | A | 1/1973 | Seltz et al. | |
| RE28,280 | E | 12/1974 | Aleks | |
| 4,040,695 | A | 8/1977 | Brann | |
| 4,182,539 | A * | 1/1980 | Busch | 312/333 |
| 4,401,350 | A | 8/1983 | Fortune | |
| 4,436,355 | A | 3/1984 | Fortune | |
| 4,561,544 | A | 12/1985 | Reeve | |
| 4,653,820 | A | 3/1987 | Tazaki | |
| 4,681,381 | A | 7/1987 | Sevey | |
| 4,893,850 | A | 1/1990 | Mizusawa | |
| 4,947,661 | A * | 8/1990 | Yoshida | 70/57 |
| 5,292,191 | A | 3/1994 | Slivon | |
| 5,388,902 | A | 2/1995 | Huebschen et al. | |
| 5,403,139 | A | 4/1995 | Slivon et al. | |
| 5,435,640 | A | 7/1995 | Holcomb | |
| 5,630,630 | A | 5/1997 | Price et al. | |
| 5,720,535 | A | 2/1998 | Mehman | |
| 5,730,511 | A | 3/1998 | Doan et al. | |
| 5,775,140 | A | 7/1998 | Hallsten | |
| 5,785,398 | A | 7/1998 | Park | |
| 5,868,478 | A | 2/1999 | Yemini | |
| 6,375,235 | B1 | 4/2002 | Mehman | |
| 6,431,615 | B1 | 8/2002 | Bastian | |
| 6,527,353 | B1 | 3/2003 | Bradfish et al. | |
| 6,547,289 | B1 | 4/2003 | Greenheck et al. | |
| 6,550,824 | B1 | 4/2003 | Ramsauer | |
| 6,601,884 | B2 | 8/2003 | Bastian | |
| 6,851,286 | B2 | 2/2005 | Dube et al. | |
| 6,997,527 | B2 | 2/2006 | Cheng | |
| 7,048,347 | B1 | 5/2006 | Liu | |
| 7,048,437 | B2 | 5/2006 | Liu | |
| 7,121,638 | B1 | 10/2006 | Eggert et al. | |
| 7,311,339 | B2 | 12/2007 | Lau | |
| RE40,267 | E | 4/2008 | Mehman | |
| 7,552,950 | B2 | 6/2009 | Scheffy | |
| 7,611,174 | B2 | 11/2009 | Lau | |
| 8,240,786 | B2 | 8/2012 | Daino et al. | |
| 2005/0218760 | A1 | 10/2005 | Cheng | |
| 2006/0103278 | A1 | 5/2006 | Bousequet | |
| 2006/0261716 | A1 | 11/2006 | Chen | |
| 2008/0150407 | A1 | 6/2008 | Mehman | |
| 2008/0276667 | A1 | 11/2008 | Scheffy et al. | |
| 2009/0127987 | A1 | 5/2009 | Daino et al. | |
| 2009/0195134 | A1 | 8/2009 | Liu et al. | |
| 2010/0019636 | A1 | 1/2010 | Chen et al. | |
| 2011/0121701 | A1* | 5/2011 | Chang | 312/332.1 |
| 2011/0309730 | A1 | 12/2011 | Retchloff et al. | |

FOREIGN PATENT DOCUMENTS

| | | |
|---|---|---|
| TW | 532264 | 5/2003 |
| TW | 533798 | 5/2003 |
| TW | 554707 | 9/2003 |
| TW | M248578 | 11/2004 |

OTHER PUBLICATIONS

Waterloo Medication Cart Series-Dual Sided Medication Cart Brochure dated May 25, 1999.

HON catalog, 310 Series Deep Full Suspension Files, p. 147, published prior to May 25, 1999.

Lista catalog, p. 10, dated prior to May 25, 1999.

Snap-0n catalog, depicting Roll Cab and Top Chest,pp. 26-27, date prior to May 25, 1999.

Bott Model R1 catalog and mobile cabinet dated prior to May 25, 1999.

International Search Report and Written Opinion from International Application No. PCT/US07/87556, May 8, 2008.

Waterloo/Lowes Drawer Latch System, offered for sale before Dec. 13, 2006; 3 pages.

Waterloo/Cornwell Elite Drawer Latch System, offered for sale before Dec. 13, 2006; 3 pages.

* cited by examiner

RANGE LIMITED LATCH

CROSS-REFERENCE TO RELATED APPLICATION

This application claims priority to and the benefit of U.S. Provisional Patent Application Ser. No. 61/865,249, entitled "RANGE LIMITED LATCH" and filed Aug. 13, 2013, the entire disclosure of which is incorporated herein by reference.

BACKGROUND

Cabinets, such as, for example, mechanics' cabinets and tool cabinets are commonly fabricated from sheet metal and may include a cabinet enclosure with one or more hinged doors and/or sliding drawers to provide access to the contents of the cabinet. In order to provide security for the contents within the cabinet, a locking system may be provided. The locking system will normally include a key actuated mechanism which enables locking of a door or drawer in a closed position. Actuation or release of the key operated mechanism is necessary in order to release or unlock the doors or drawers. Additionally or alternatively, a cabinet may be provided with a release latch for retaining an unlocked drawer or door in a closed position against inadvertent opening of the drawer or door (e.g., due to bumping, jostling, or tipping of the cabinet). User manipulation of a release member (e.g., a lever, knob, button, slideable or pivotable handle, or other such mechanism) moves the release latch to a drawer or door releasing position to allow the drawer or door to open.

SUMMARY

According to an exemplary embodiment of the present application, a latch mechanism includes a latchable structure and a latch member assembled with the latchable structure and movable between a latching position and a releasing position. The latch member includes a first stop portion positioned to engage a second stop portion carried by the latchable structure when the latch member is in one of the latching position and the releasing position.

In another exemplary embodiment, a drawer includes a drawer enclosure including a front wall and a side wall, and a latch member assembled with the drawer enclosure and pivotable between a latching position and a releasing position. The latch member includes a first stop portion positioned to engage a second stop portion carried by the drawer enclosure when the latch member is in one of the latching position and the releasing position.

In still another exemplary embodiment, a cabinet includes a cabinet enclosure defining an internal cavity and a drawer assembled with the cabinet enclosure and slideable from a closed position disposed within the internal cavity to an open position. The drawer includes a drawer enclosure including a front wall and a side wall, and a latch member assembled with the drawer enclosure and pivotable between a latching position in which an interlocking end of the latch member interlocks with a strike plate of the cabinet enclosure, and a releasing position in which the interlocking end of the latch member disengages from the strike plate to permit movement of the drawer to the open position. The latch member includes a first stop portion positioned to engage a second stop portion carried by the drawer enclosure when the latch member is in one of the latching position and the releasing position.

BRIEF DESCRIPTION OF THE DRAWINGS

Further features and advantages of the invention will become apparent from the following detailed description made with reference to the accompanying drawings, wherein.

DETAILED DESCRIPTION

The Detailed Description merely describes exemplary embodiments and is not intended to limit the scope of the claims in any way. Indeed, the invention as claimed and described is broader than and unlimited by the exemplary embodiments, and the terms used in the claims have their full ordinary meaning.

A cabinet release latch mechanism may include a pivotable latch member with a latching or interlocking portion that interlocks with a strike member (e.g., an apertured plate or flange) to retain a drawer or door in a closed position. In one embodiment, the pivotable latch member is assembled with, disposed on, or otherwise carried by a drawer or door of the cabinet, and the strike member is assembled with, disposed on, or otherwise carried by an enclosure of the cabinet. In another embodiment, the pivotable latch member is carried by the cabinet enclosure and the strike member is carried by the drawer or door. The pivotable latch member may be biased (e.g., by a spring, gravitational biasing, component flexure) toward the interlocking position, such that user operation of the latch member (e.g., by manipulation of a handle or other interface) is required to pivot the latch member out of interlocking engagement with the strike member to allow the drawer or door to be opened. Examples of pivoting drawer latch mechanisms are described in U.S. Pat. No. 6,375,235 and U.S. Patent Application Pub. No. 2008/0150407, and examples of pivoting door latch mechanism are described in U.S. Pat. No. 8,240,786, the entire disclosures of each of which are incorporated herein by reference.

The present application describes arrangements for limiting a range of movement of a pivotable latch member, for example, to provide a positive stop for the latch member in at least one of an interlocking or latching position and a releasing position, to prevent over-rotation of the latch member, and/or to prevent marring or galling damage between the latch member and the strike member. According to an aspect of the present application, a pivotable latch member may be provided with one or more stop portions positioned to engage one or more stop portions to limit a range of movement of the latch member. In one such embodiment, the pivotable latch member is assembled with a latchable structure (e.g., a drawer, door, or cabinet enclosure) and is provided with one or more stop portions positioned to engage one or more stop portions carried by the latchable structure. Many different types of stop portions may be utilized for range limiting engagement between a pivotable latch and a latchable structure, including, for example, pins, fasteners, tabs, flanges, blocks, cutouts, slots, and notches.

Figure 1A:
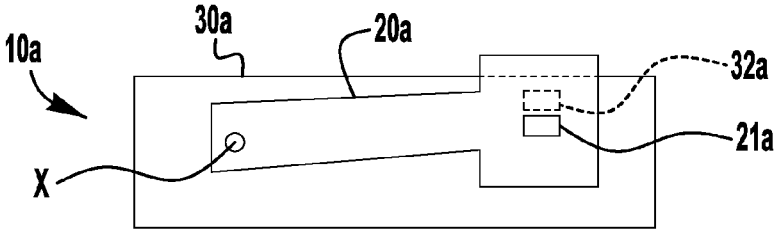
FIG. 1A illustrates a schematic view of a range limited latch mechanism, in accordance with an exemplary embodiment.

In an exemplary latch mechanism 10*a*, as schematically shown in FIG. 1A, a latch member 20*a* is assembled with a latchable structure 30*a* and is pivotable about a longitudinal axis X between a latching position and a releasing position. The latch member 20*a* includes a first longitudinally extending stop portion 21*a* positioned to engage a second longitudinally extending stop portion 32*a* carried by the latchable structure 30*a* when the latch member 20*a* is in the latching position.

Figure 1B:
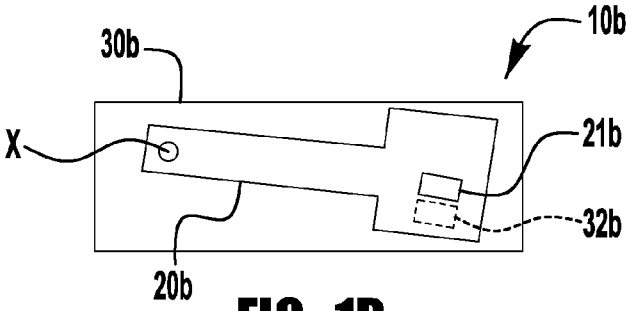
FIG. 1B illustrates a schematic view of a range limited latch mechanism, in accordance with another exemplary embodiment.

In another exemplary latch mechanism 10*b*, as schematically shown in FIG. 1B, a latch member 20*b* is assembled with a latchable structure 30*b* and is pivotable about a longitudinal axis X between a latching position and a releasing position. The latch member 20*b* includes a first longitudinally extending stop portion 21*b* positioned to engage a second longitudinally extending stop portion 32*b* carried by the latchable structure 30*b* when the latch member 20*b* is in the releasing position.

Figure 1C:
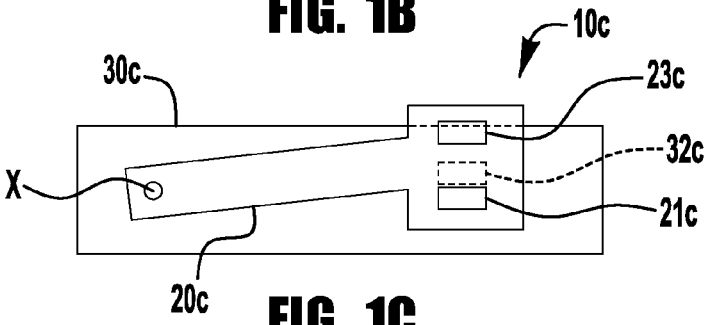
FIG. 1C illustrates a schematic view of a range limited latch mechanism, in accordance with another exemplary embodiment.

In still another exemplary latch mechanism 10*c*, as schematically shown in FIG. 1C, a latch member 20*c* is assembled with a latchable structure 30*c* and is pivotable about a longitudinal axis X between a latching position and a releasing position. The latch member 20*c* includes a first longitudinally extending stop portion 21*c* positioned to engage a second longitudinally extending stop portion 32*c* carried by the latchable structure 30*c* when the latch member 20*c* is in the latching position, and a third longitudinally extending stop portion 23*c* positioned to engage the second longitudinally extending stop portion 32*c* when the latch member 20*c* is in the latching position.

Figure 1D:
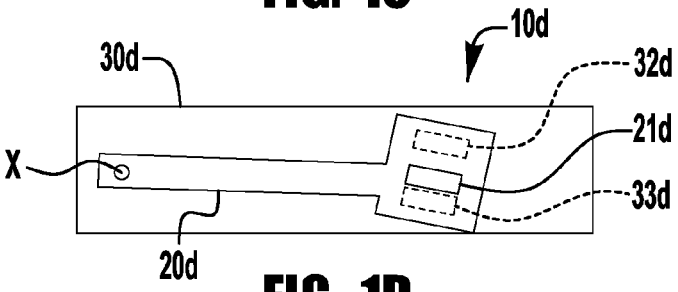
FIG. 1D illustrates a schematic view of a range limited latch mechanism, in accordance with another exemplary embodiment.

In yet another exemplary latch mechanism 10*d*, as schematically shown in FIG. 1D, a latch member 20*d* is assembled with a latchable structure 30*d* and is pivotable about a longitudinal axis X between a latching position and a releasing position. The latch member 20*d* includes a first longitudinally extending stop portion 21*d* positioned to engage a second longitudinally extending stop portion 32*d* carried by the latchable structure 30*d* when the latch member 20*d* is in the latching position, and positioned to engage a third longitudinally extending stop portion 33*d* carried by the latchable structure 30*d* when the latch member 20*d* is in the latching position.

Figure 1E:
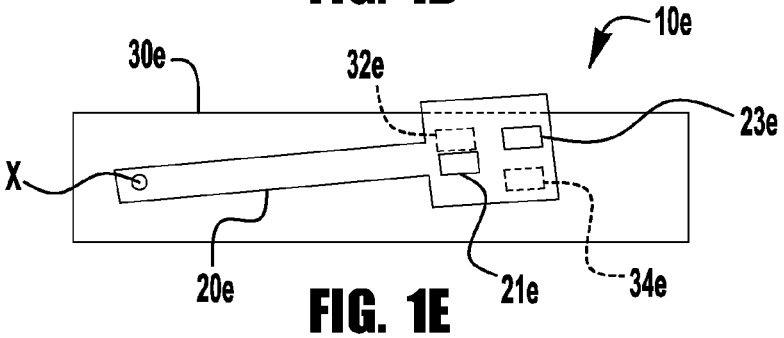
FIG. 1E illustrates a schematic view of a range limited latch mechanism, in accordance with another exemplary embodiment.
Figure 2:
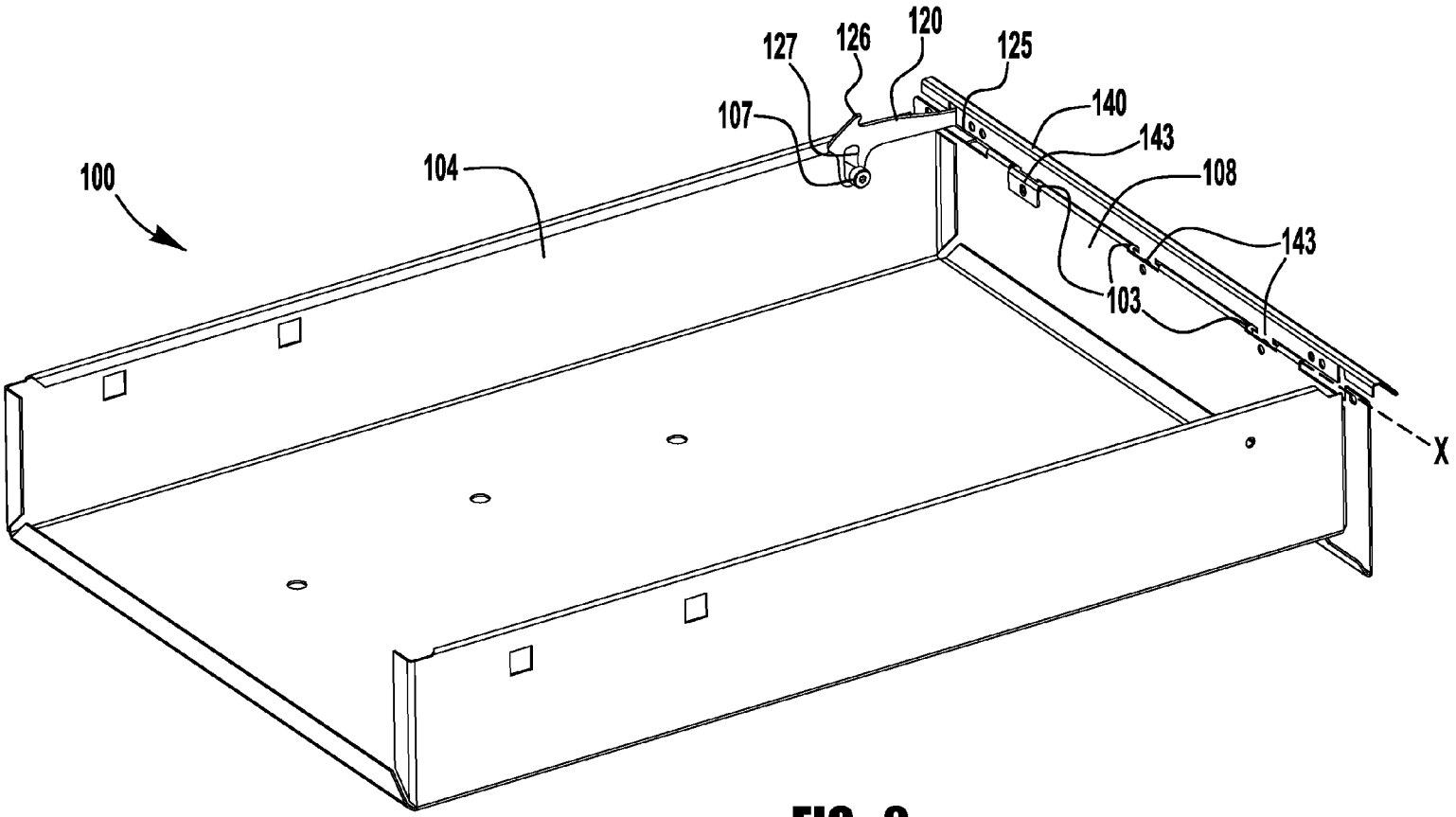
FIG. 2 illustrates a perspective view of a cabinet drawer including a range limited latch mechanism, in accordance with another exemplary embodiment.
Figure 3:
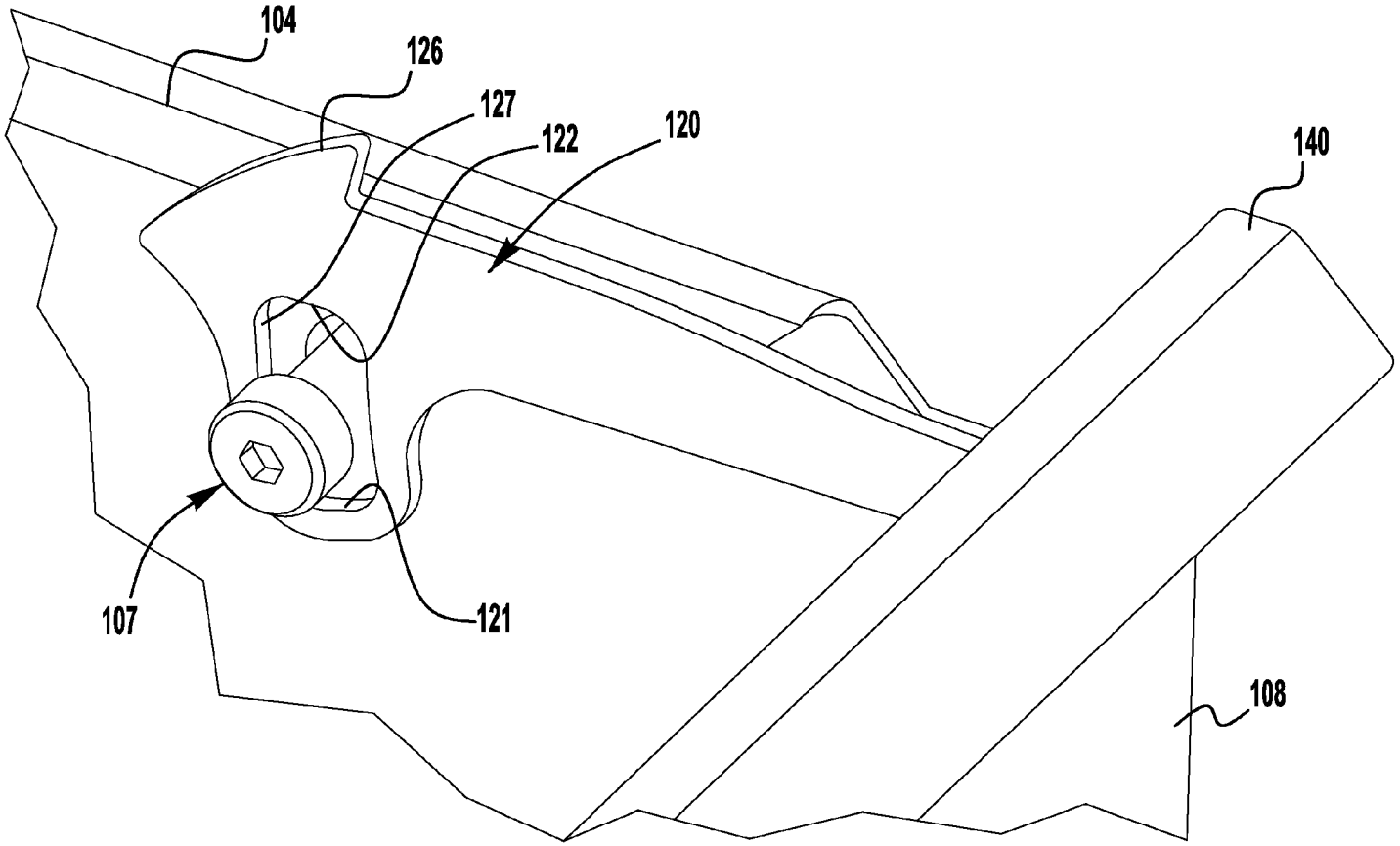
FIG. 3 illustrates an enlarged perspective view of the latch mechanism of FIG. 2.
Figure 4:
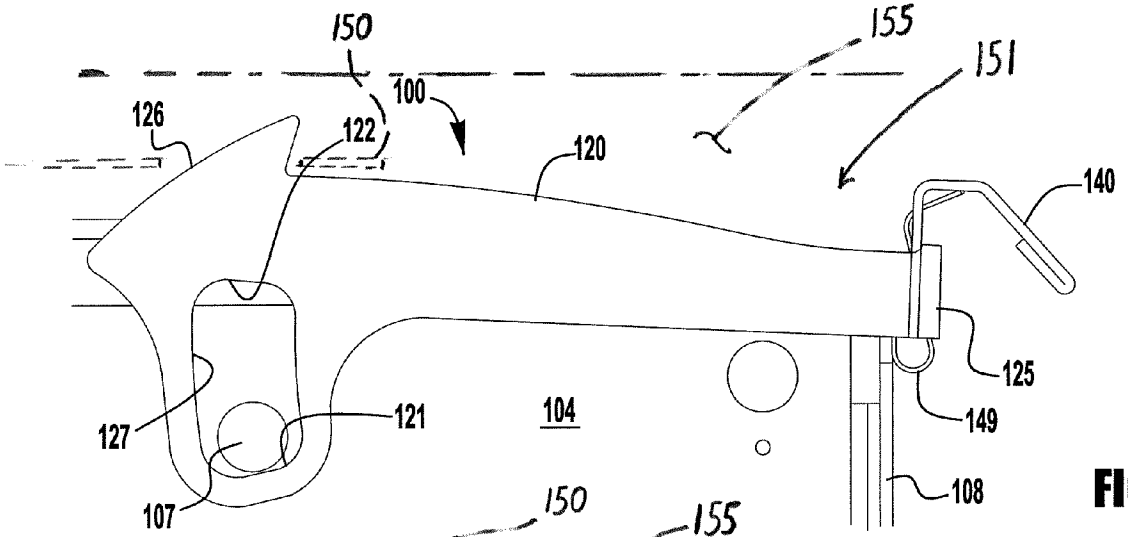
FIG. 4 illustrates a side view of the latch mechanism of FIG. 2, shown in a first limit position.
Figure 5:
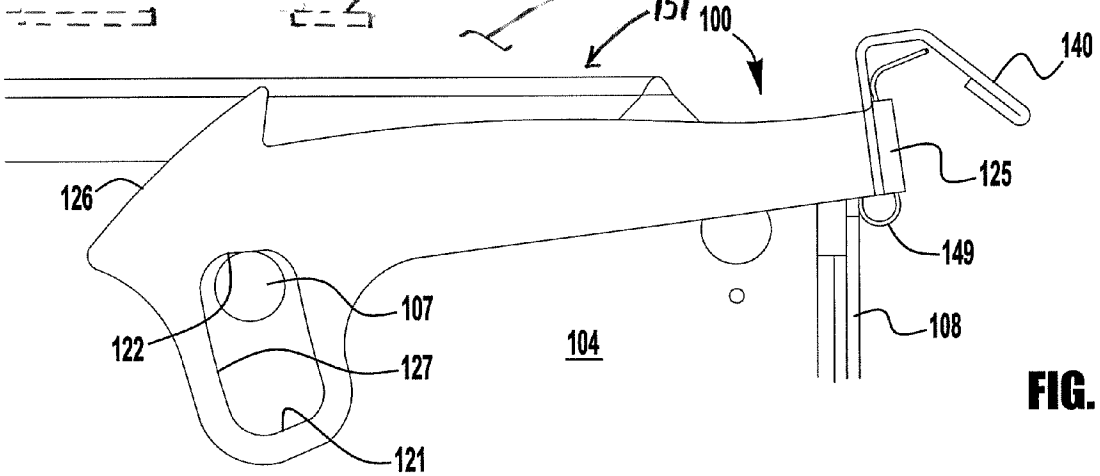
FIG. 5 illustrates a side view of the latch mechanism of FIG. 2, shown in a second limit position.

In another exemplary latch mechanism 10*e*, as schematically shown in FIG. 1E, a latch member 20*e* is assembled with a latchable structure 30*e* and is pivotable about a longitudinal axis X between a latching position and a releasing position. The latch member 20*e* includes a first longitudinally extending stop portion 21*e* positioned to engage a second longitudinally extending stop portion 32*e* carried by the latchable structure 30*e* when the latch member 20*e* is in the latching position, and a third longitudinally extending stop portion 23*e* positioned to engage a fourth longitudinally extending stop portion 34*e* carried by the latchable structure 30*e* when the latch member 20*e* is in the latching position.

In an exemplary embodiment, as shown in FIGS. 2-5, a cabinet drawer 100, having a front wall 108, first and second side walls 104, a bottom wall, and a rear wall (not shown), includes a pivotable latch member 120 attached to (e.g., integral to or assembled with) a user operable drawer release handle 140. The drawer release handle 140 is pivotably mounted to the front wall 108 of the drawer enclosure, for example, by tabs 143 received in slots 103 in the front wall 108, such that the handle 140 and latch member 120 are pivotable about a longitudinal axis X defined by the pivotable attachment of the handle 140 to the front wall 108.

The exemplary latch member 120 includes a flange end 125 secured to the release handle 140 (e.g., by fasteners) and an interlocking end or tang 126 shaped and positioned to engage a strike member 150 (FIGS. 4 and 5) secured to the cabinet enclosure 155 (e.g., an apertured strike plate, as shown in the above-incorporated U.S. Pat. No. 6,375,235 and U.S. Patent Application Pub. No. 2008/0150407). Pivoting movement of the release handle 140 pivots the latch member 120 to disengage the tang 126 from the strike member, thereby permitting withdrawal of the drawer 100 from a cavity 151 defined by the cabinet enclosure.

To limit pivoting movement of the latch member 120, a stop pin 107 is assembled with a side wall 104 of the drawer 100, and extends through a slot 127 in the latch member 120. As shown, the stop pin 107 may be positioned such that the stop pin 107 engages a first end portion or stop portion 121 of the slot 127 when the latch member 120 is in the interlocking position (see FIG. 4). Additionally or alternatively, the stop pin 107 may be positioned such that the stop pin 107 engages a second end portion or stop portion 122 of the slot 127 when the latch member 120 is in the releasing position (see FIG. 5).

Figure 6:
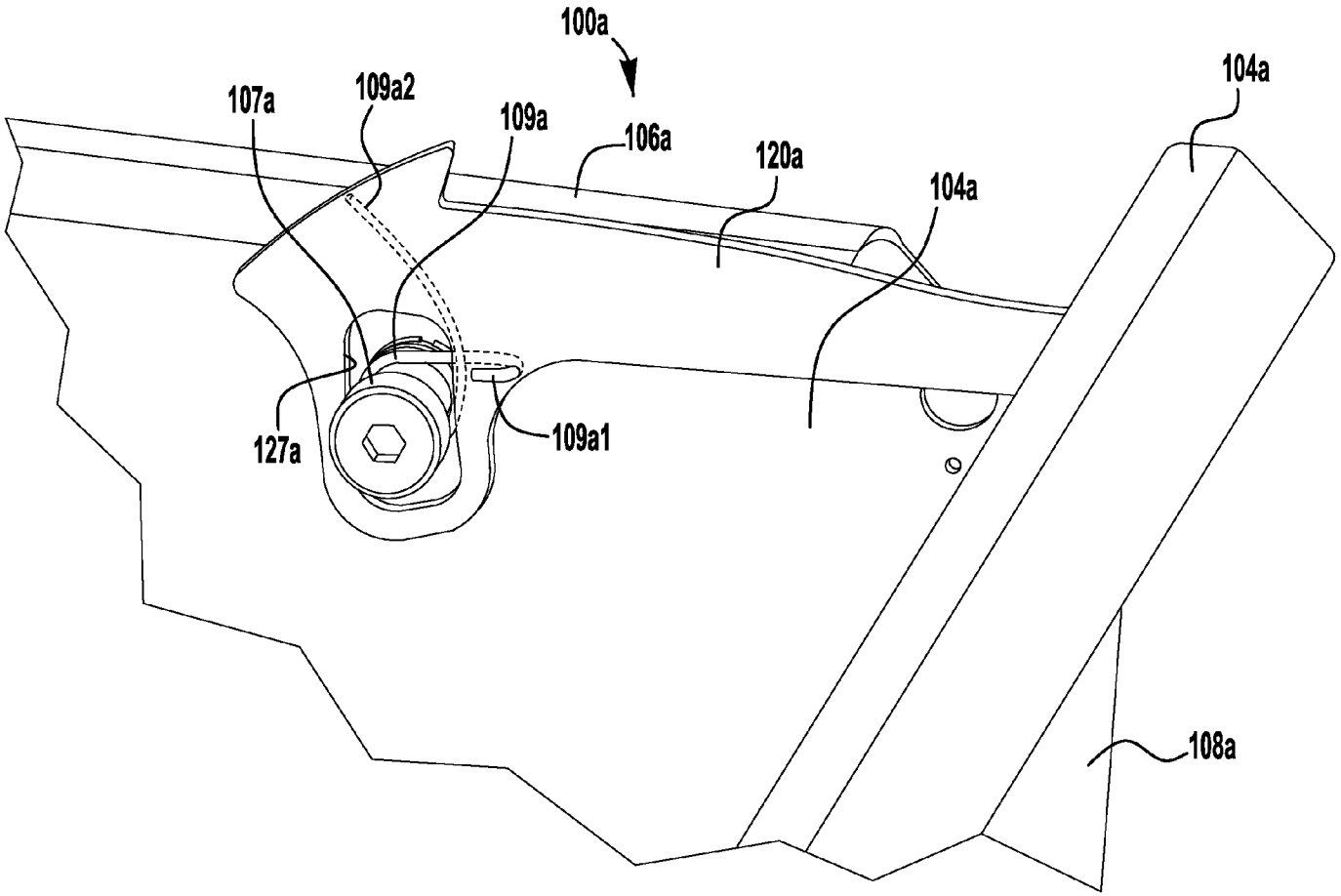
FIG. 6 illustrates a perspective view of a range limited latch mechanism, in accordance with another exemplary embodiment.

The latch mechanism may include a biasing spring or other biasing component configured to bias the latch member and operatively connected handle toward the latched or interlocking position. In the illustrated embodiment, as evident in FIGS. 4 and 5, a leaf spring 149 assembled between the handle 140 and the drawer front wall 108 applies a biasing force to the handle 140 to bias the handle 140 (and with it, the latch member 120) toward the interlocking position. In another embodiment, as shown in FIG. 6, a cabinet drawer 100*a* may additionally or alternatively include a spring (e.g., a torsion spring) 109*a* assembled between the stop pin 107*a* and the drawer side wall 104*a* to bias the latch member 120*a* (and with it, the handle 140*a*) toward the interlocking position. In the illustrated embodiment, the spring 109*a* is coiled around the stop pin 107*a*, with a first end 109*a*1 anchored in a hole in the latch member 120*a*, and a second end 109*a*2 retained within a folded upper flange 106*a* of the drawer side wall 104*a*

Figure 7:
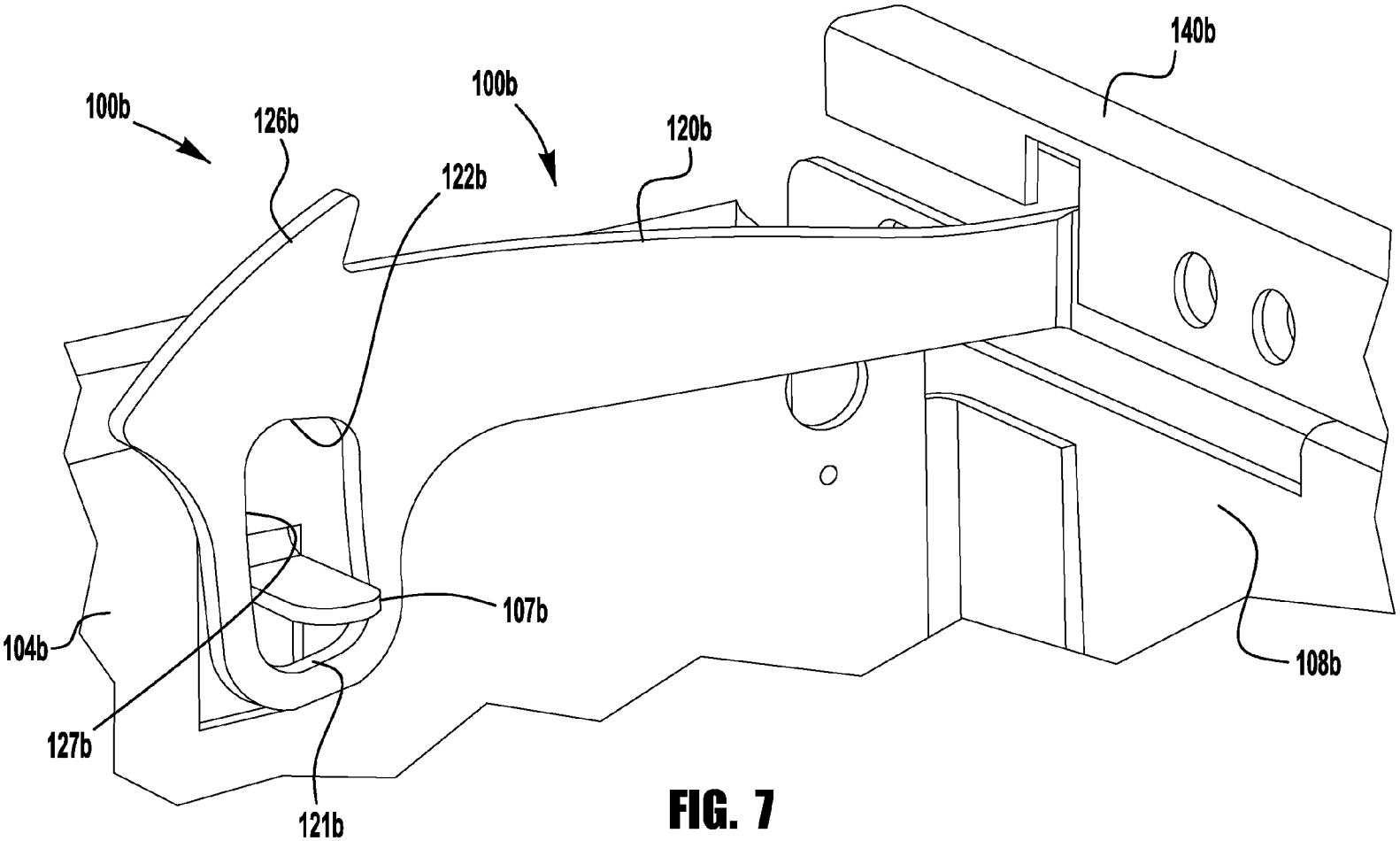
FIG. 7 illustrates a perspective view of a range limited latch mechanism, in accordance with another exemplary embodiment.

Other types of stopping portions and stopping engagement of a latch member may additionally or alternatively be utilized. For example, as shown in FIG. 7, the cabinet side wall 104*b* may be provided with an integral bent tab 107*b* that extends through a slot 127*b* in the latch member 120*b*. The tab 107*b* may be positioned such that the tab engages a first end portion or stop portion 121*b* of the slot 127*b* when the latch member 120*b* is in the interlocking position. Additionally or alternatively, the tab 107*b* may be positioned such that the tab engages a second end portion or stop portion 122*b* of the slot 127*b* when the latch member 120*b* is in the releasing position.

Figure 8:
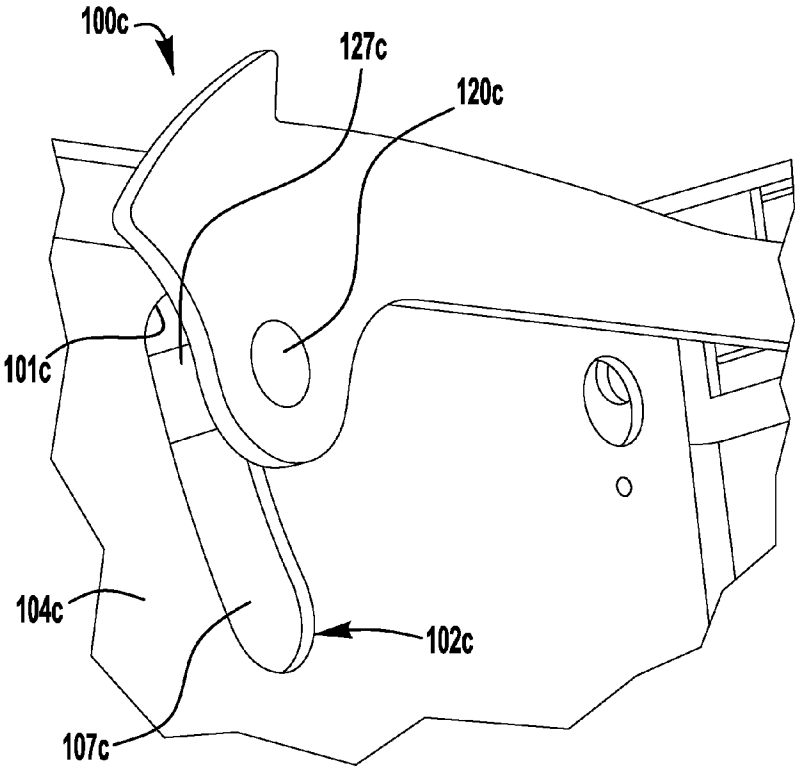
FIG. 8 illustrates a perspective view of a range limited latch mechanism, in accordance with still another exemplary embodiment.

In another exemplary embodiment, as shown in FIG. 8, the latch member 120*c* may be provided with a stop pin 127*c* that extends through a slot 107*c* in the cabinet side wall 104*c*. The stop pin 127*c* may be positioned such that the stop pin engages a first end portion or stop portion 101*c* of the slot 107*c* when the latch member 120*b* is in the interlocking position. Additionally or alternatively, the stop pin 127*c* may be positioned such that the stop pin engages a second end portion or stop portion 102*c* of the slot 107*c* when the latch member 120*c* is in the releasing position.

Figure 9:
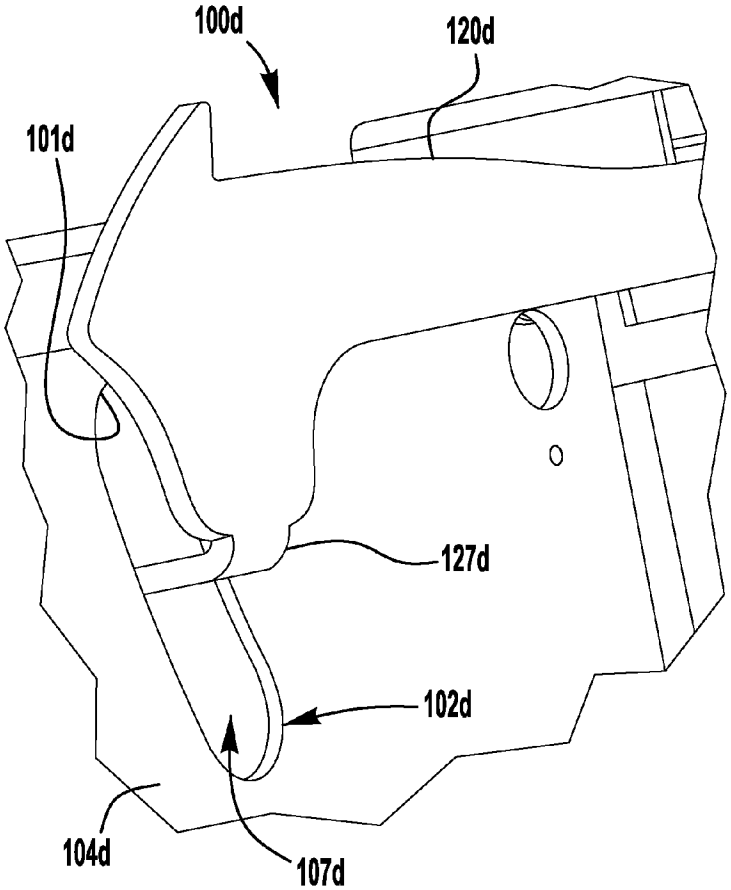
FIG. 9 illustrates a perspective view of a range limited latch mechanism, in accordance with yet another exemplary embodiment.

In another exemplary embodiment, as shown in FIG. 9, the latch member 120*d* may be provided with an integral bent tab 127*d* that extends through a slot 107*d* in the cabinet side wall 104*d*. The tab 127*d* may be positioned such that the tab engages a first end portion or stop portion 101*d* of the slot 107*d* when the latch member 120*d* is in the interlocking position. Additionally or alternatively, the tab 127*d* may be positioned such that the tab engages a second end portion or stop portion 102*d* of the slot 107*d* when the latch member 120*d* is in the releasing position.

Figure 10:
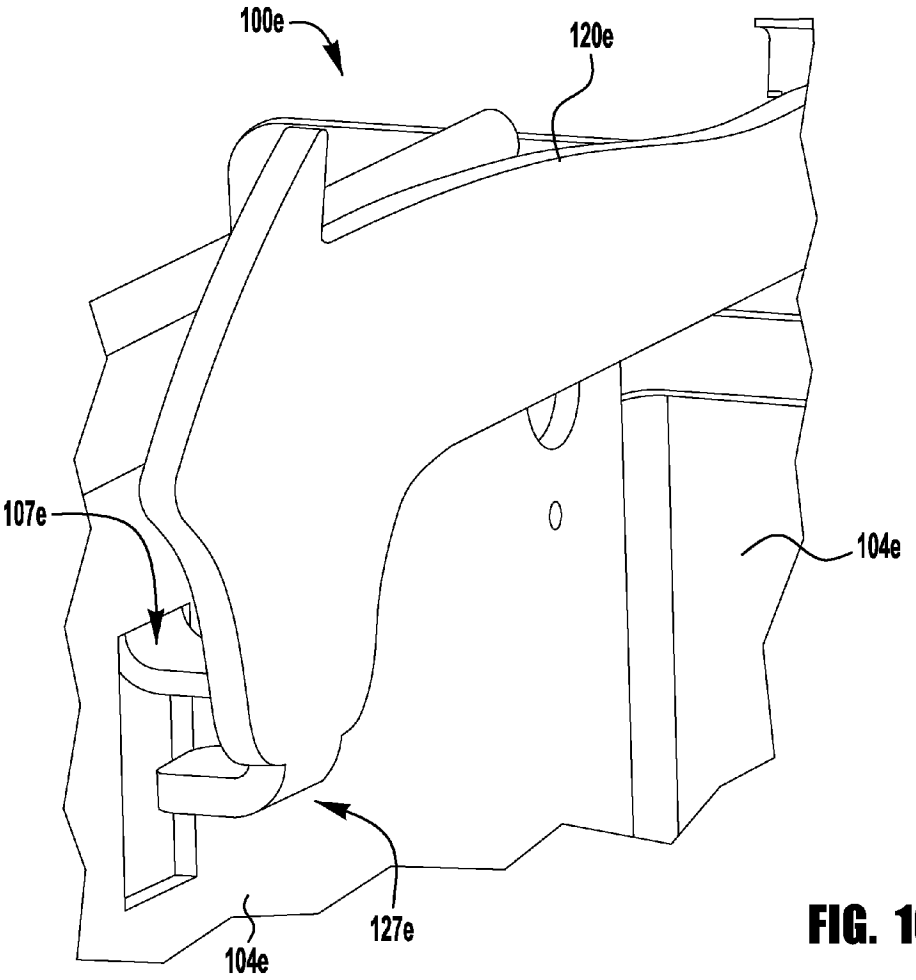
FIG. 10 illustrates a perspective view of a range limited latch mechanism, in accordance with another exemplary embodiment.

In still another exemplary embodiment, as shown in FIG. 10, the latch member 120*e* may be provided with an integral bent tab 127*e* positioned to engage an integral bent tab 107*e* disposed on the cabinet side wall 104*e* when the latch member 120*e* is in the interlocking position. Additionally or alternatively (not shown), a similar integral bent tab may be provided on the latch member for engagement with a bent tab on the cabinet side wall when the latch member is in the releasing position.

According to another aspect of the present application, a range limited latch member may be pivotally connected directly to the same wall or other structural element on which a latch engaging stop portion is disposed. In such an arrangement, the latch member may remain detached from a user operable handle or other interface, for example, to facilitate assembly of the cabinet drawer, or to reduce the number of manufacturing tolerances that can affect the consistent performance of the latch.

In one embodiment, a latch member may be pivotably mounted to a cabinet drawer side wall defining a latch engaging side portion. In the illustrated embodiment of FIGS. 11-13, a cabinet drawer 100*f* includes a pivotable latch member 120*f* having a first end 125*f* pivotably attached to a cabinet drawer side wall 104*f* by a mounted pivot pin 105*f* (e.g., a threaded fastener) installed through a hole in the latch member 120*f*. The exemplary latch member 120*f* includes an interlocking end or tang 126*f* shaped and positioned to engage a strike member secured to the cabinet enclosure.

To limit pivoting movement of the latch member 120*f*, a stop pin 107*f* is assembled with the side wall 104*f* of the drawer 100*f*, and extends through a slot 127*f* in the latch member 120*f*. As shown, the stop pin 107*f* may be positioned such that the stop pin 107*f* engages a first end portion or stop portion 121*f* of the slot 127*f* when the latch member 120*f* is in the interlocking position (see FIG. 12). Additionally or alternatively, the stop pin 107*f* may be positioned such that the stop pin 107*f* engages a second end portion or stop portion 122*f* of the slot 127*f* when the latch member 120*f* is in the releasing position (see FIG. 13). Other types of stopping portions and stopping engagement of a latch member may additionally or alternatively be utilized, as shown, for example, in the exemplary embodiments of FIGS. 7-10.

A drawer release handle 140*f* is pivotably mounted to a front wall 108*f* of the drawer 100*f*, for example, by tabs received in slots in the front wall (similar to the embodiment of FIGS. 2-5), such that the handle 140*f* is pivotable about a longitudinal axis X defined by the pivotable attachment of the handle 140*f* to the front wall 108*f*. To operatively connect the drawer release handle 140*f* to the latch member 120*f*, the drawer release handle 140*f* is provided with a latch engaging projection 145*f* that extends above and proximate to the latch member 120*f*, such that pivoting movement of the release handle 140*f* causes the projection 145*f* to engage an upper edge of the latch member 120*f*, pivoting the latch member to disengage the tang 126*f* from the strike member, thereby permitting withdrawal of the drawer 100*f* from the cabinet enclosure. Other latch engaging arrangements may additionally or alternatively be utilized, including, for example, a pushbutton operated projection that engages an upper edge of the latch.

The latch mechanism may include one or more biasing springs or other biasing components configured to bias one or both of the latch member and operatively connected handle toward the latched or interlocking position. In the illustrated embodiment, as evident in FIGS. 12 and 13, a leaf spring 149*f* assembled between the handle 140*f* and the drawer front wall 108*f* applies a biasing force to the handle 140*f* to bias the handle 140*f* toward the interlocking position. Also, similar to the embodiment of FIG. 6, the cabinet drawer may additionally or alternatively include a spring (e.g., a torsion spring) assembled between the stop pin and the drawer side wall to bias the latch member (and with it, the handle) toward the interlocking position.

Figure 14:
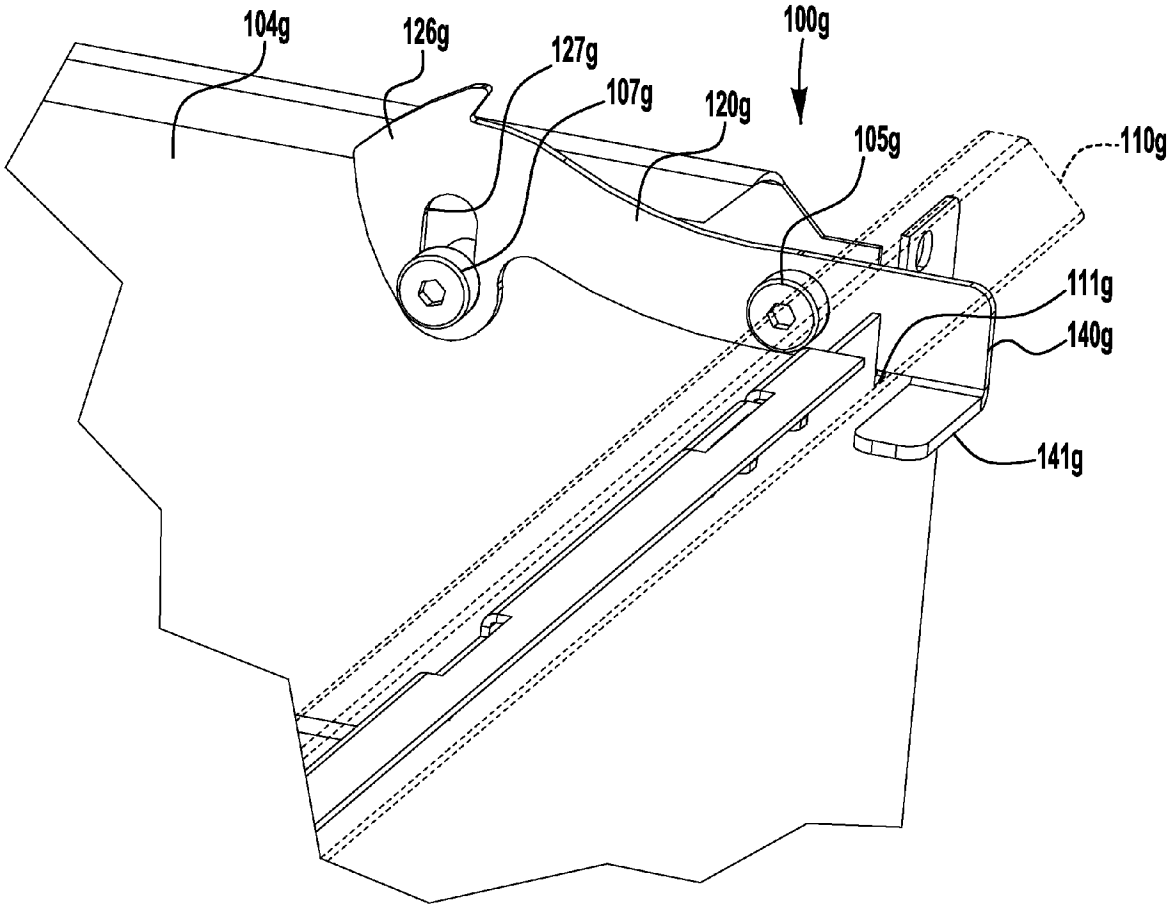
FIG. 14 illustrates a perspective view of a range limited latch mechanism, in accordance with another exemplary embodiment, with the drawer handle shown in broken lines to illustrate additional features of the mechanism.

In another exemplary embodiment, a range limited latch member that is pivotably connected to a latchable structure may be directly connected to (e.g., assembled with or integral to) a user operable release member spaced apart from the latch member pivot axis. In the illustrated embodiment of FIG. 14, a cabinet drawer 100*g* includes a pivotable latch member 120*g* pivotably attached to a cabinet drawer side wall 104*g* by a mounted pivot pin 105*g* (e.g., a threaded fastener) installed through a hole in the latch member 120*g*. The exemplary latch member 120*g* includes an interlocking end or tang 126*g* shaped and positioned to engage a strike member secured to the cabinet enclosure.

Figure 11:
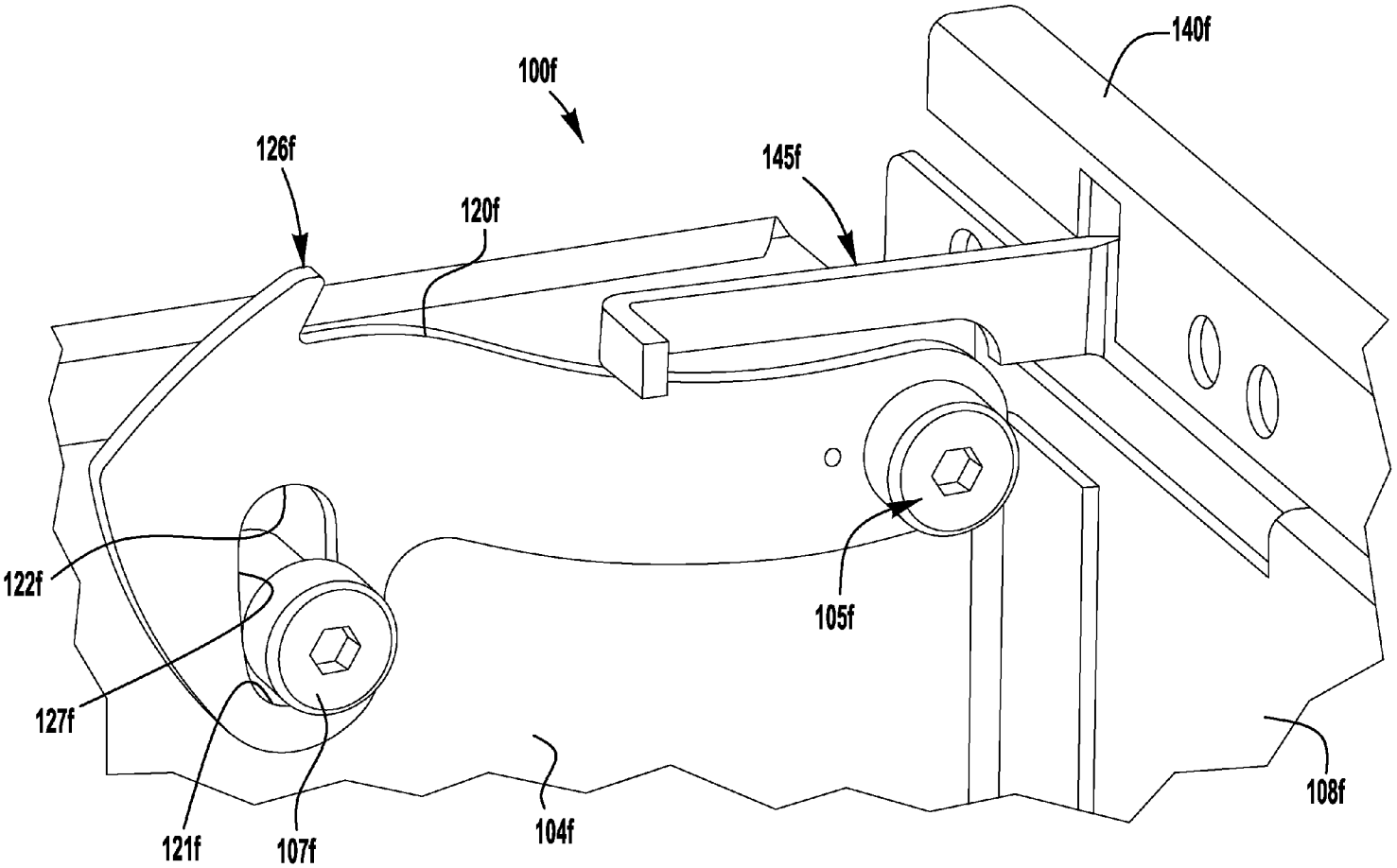
FIG. 11 illustrates a perspective view of a range limited latch mechanism, in accordance with another exemplary embodiment.
Figure 12:
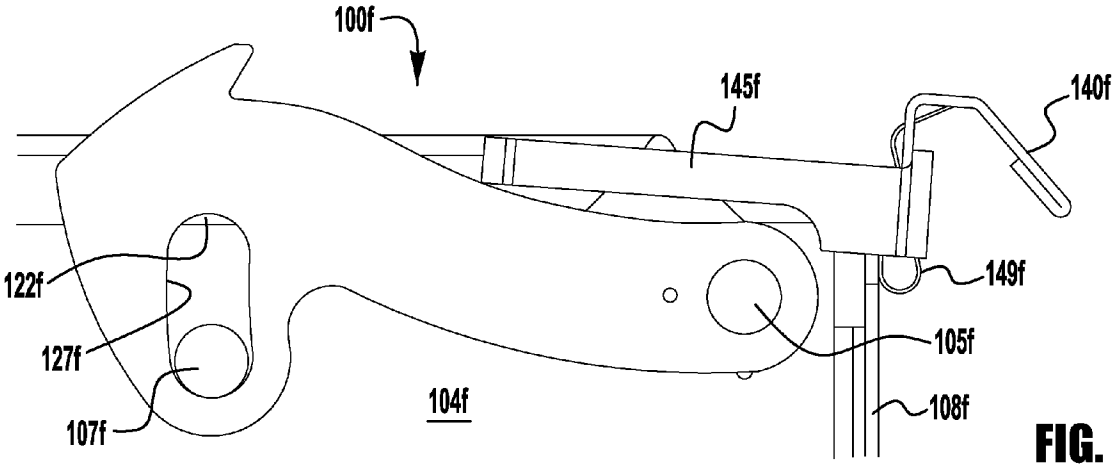
FIG. 12 illustrates a side view of the latch mechanism of FIG. 11, shown in a first limit position.
Figure 13:
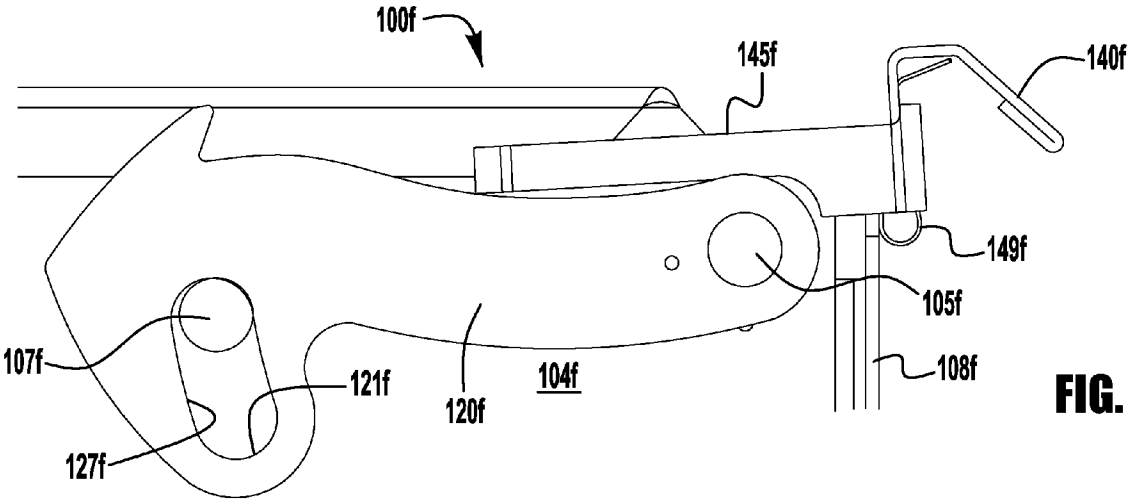
FIG. 13 illustrates a side view of the latch mechanism of FIG. 11, shown in a second limit position.

Similar to the embodiment of FIGS. 11-13, a stop pin 107*g* is assembled with the side wall 104*g* of the drawer 100*g*, extending through a slot 127*g* in the latch member

120*g*, to limit pivoting movement of the latch member 120*g*. Other types of stopping portions and stopping engagement of a latch member may additionally or alternatively be utilized, as shown, for example, in the exemplary embodiments of FIGS. 7-10.

The exemplary latch member is provided with a drawer release member 140*g* extending outward of the pivot pin 105*g* (opposite the interlocking end 126*g*) through a slot 111*g* in the front wall 108*g* of the drawer 100*g* below a fixed drawer handle 110*g*, such that the release member 140*g* is operable to pivot the latch member 120*g* about pivot pin 105*g*. The drawer release member 140*g* may include a bent tab 141*g* or other user engageable portion to facilitate pivoting movement of the latch member 120*g*. As described above, the latch mechanism may include one or more biasing springs or other biasing components configured to bias the latch member and release member toward the latched or interlocking position.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, circuits, devices and components, software, hardware, control logic, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

We claim:

1. A latch mechanism comprising:

a latchable structure including a front wall and a side wall; and a latch member assembled with the latchable structure and including a first pivot end proximate to the front wall and a second interlocking end opposite the pivot end and distal to the front wall, the latch member being pivotable about the pivot end between a latching position and a releasing position;

wherein the interlocking end of the latch member includes a first stop portion positioned to engage a second stop portion carried by the side wall of the latchable structure when the latch member is in one of the latching position and the releasing position; and wherein one of the first and second stop portions comprises an edge of a slot and the other of the first and second stop portions comprises a projection extending through the slot.

2. The latch mechanism of claim 1, wherein the latchable structure comprises one of a drawer and a door.

3. The latch mechanism of claim 1, wherein the first stop portion is positioned to engage the second stop portion when the latch member is in the latching position.

4. The latch mechanism of claim 1, wherein the first stop portion is positioned to engage the second stop portion when the latch member is in the releasing position.

5. The latch mechanism of claim 1, wherein the projection comprises at least one of a pin, a fastener, and a bent tab.

6. The latch mechanism of claim 1, wherein the latch member further comprises a third stop portion, wherein the third stop portion is positioned to engage the second stop portion when the latch member is in the other of the latching position and the releasing position.

7. The latch mechanism of claim 6, wherein the first and third stop portions comprise first and second opposed edges of a slot disposed in the latch member and the second stop portion comprises a projection extending through the slot.

8. The latch mechanism of claim 1, wherein the latch member further comprises a third stop portion and the latchable structure further comprises a fourth stop portion, wherein the third stop portion is positioned to engage the fourth stop portion when the latch member is in the other of the latching position and the releasing position.

9. The latch mechanism of claim 1, further comprising a spring member that biases the latch member toward the latching position.

10. The latch mechanism of claim 9, wherein the spring member is assembled with the second stop portion.

11. The latch mechanism of claim 1, further comprising a user operable release member assembled with the latchable structure and operable to move the latch member to the releasing position.

12. The latch mechanism of claim 11, wherein the user operable release member is attached to the latch member.

13. The latch mechanism of claim 11, wherein the user operable release member is integral with the latch member.

14. The latch mechanism of claim 1, wherein the latch member is pivotably secured to the latchable structure by a pivot pin.

15. The latch mechanism of claim 14, wherein the second stop portion comprises a stop pin assembled with the latchable structure, wherein the stop pin extends substantially parallel to the pivot pin.

16. A drawer comprising:

a drawer enclosure including a front wall and a side wall; and a latch member assembled with the drawer enclosure and including a first pivot end proximate to the front wall and a second interlocking end opposite the pivot end and distal to the front wall, the latch member being pivotable about the pivot end between a latching position and a releasing position;

wherein the interlocking end of the latch member includes a first stop portion positioned to engage a second stop portion carried by the side wall of the drawer enclosure when the latch member is in one of the latching position and the releasing position; and wherein one of the first and second stop portions comprises an edge of a slot and the other of the first and second stop portions comprises a projection extending through the slot.

17. The drawer of claim 16, further comprising a drawer release handle assembled with the front wall of the drawer enclosure, the drawer release handle being operable to pivot the latch member to the releasing position.

18. The drawer of claim 17, wherein the latch member is secured to the drawer release handle for pivotable movement therewith.

19. The drawer of claim 17, wherein the latch member is detached from the drawer release handle.

20. The drawer of claim 16, wherein the latch member is pivotably secured to the side wall.

21. The drawer of claim 16, wherein the latch member is pivotably secured to the side wall by a pivot pin.

22. A cabinet comprising:

a cabinet enclosure defining an internal cavity; and a drawer assembled with the cabinet enclosure and slideable from a closed position disposed within the internal cavity to an open position, the drawer comprising:

a drawer enclosure including a front wall and a side wall; and a latch member assembled with the drawer enclosure and including a first pivot end proximate to the front wall and a second interlocking end opposite the pivot end and distal to the front wall, the latch member being pivotable about the pivot end between a latching position in which the interlocking end of the latch member interlocks with a strike plate of the cabinet enclosure, and a releasing position in which the interlocking end of the latch member disengages from the strike plate to permit movement of the drawer to the open position;

wherein the interlocking end of the latch member includes a first stop portion positioned to engage a second stop portion carried by the side wall of the drawer enclosure when the latch member is in one of the latching position and the releasing position.

23. The cabinet of claim 22, wherein one of the first and second stop portions comprises an edge of a slot and the other of the first and second stop portions comprises a projection extending through the slot.

* * * * *